US008629751B2

(12) United States Patent
Maher et al.

(10) Patent No.: US 8,629,751 B2
(45) Date of Patent: Jan. 14, 2014

(54) HIGH AMPERAGE SURGE ARRESTERS

(75) Inventors: Kathryn Marie Maher, Cary, NC (US); Matthew Spalding, Fuquay Varina, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/325,646

(22) Filed: Dec. 14, 2011

(65) Prior Publication Data

US 2013/0154789 A1 Jun. 20, 2013

(51) Int. Cl.
*H01C 7/10* (2006.01)

(52) U.S. Cl.
USPC ..... 338/20; 338/21; 361/124

(58) Field of Classification Search
USPC ..... 338/20, 21
See application file for complete search history.

(56) References Cited

U.S. PATENT DOCUMENTS

| | | | | |
|---|---|---|---|---|
| 2,608,600 | A * | 8/1952 | Nilsson et al. | 361/129 |
| 4,203,143 | A * | 5/1980 | Imataki et al. | 361/120 |
| 4,335,417 | A | 6/1982 | Sakshaug et al. | |
| 4,495,482 | A | 1/1985 | Philipp | |
| 4,656,555 | A | 4/1987 | Raudabaugh | |
| 4,812,944 | A | 3/1989 | Eberhard et al. | |
| 4,833,438 | A * | 5/1989 | Parraud et al. | 338/21 |
| 5,039,452 | A | 8/1991 | Thompson et al. | |
| 5,070,050 | A | 12/1991 | Dupon et al. | |
| 5,130,280 | A | 7/1992 | Dupon et al. | |
| 5,188,886 | A | 2/1993 | Dupon et al. | |
| 5,497,138 | A * | 3/1996 | Malpiece et al. | 338/21 |
| 5,680,289 | A | 10/1997 | Robinson et al. | |
| 5,684,665 | A * | 11/1997 | Rudy | 361/117 |
| 6,466,425 | B1 * | 10/2002 | Shirakawa et al. | 361/117 |
| 7,522,399 | B2 * | 4/2009 | Siljeholm et al. | 361/127 |
| 8,305,184 | B2 * | 11/2012 | Klaube et al. | 338/21 |

FOREIGN PATENT DOCUMENTS

| | | |
|---|---|---|
| DE | 34 26 054 A1 | 12/1985 |
| EP | 0 196 370 A1 | 10/1986 |
| EP | 0 274 674 A1 | 7/1988 |

OTHER PUBLICATIONS

International Search Report Corresponding to International Application No. PCT/US2012/069479; Date of Mailing: Mar. 12, 2013; 10 Pages.

* cited by examiner

*Primary Examiner* — Kyung Lee
(74) *Attorney, Agent, or Firm* — Myers Bigel Sibley & Sajovec P.A.

(57) ABSTRACT

A high-voltage surge arrester includes an electrically conductive first terminal and an electrically conductive second terminal longitudinally spaced from the first terminal. A plurality of metal oxide varistor (MOV) bars are included, each of which extends from the first terminal to the second terminal and electrically contacts the first terminal and the second terminal. A heat conducting material contacts the MOV bars.

20 Claims, 5 Drawing Sheets

HIGH AMPERAGE SURGE ARRESTERS

BACKGROUND OF THE INVENTION

The present invention relates to surge arresters and, more particularly, to high voltage surge arresters.

Current designs of power lightning arresters used to dissipate electrical surges induced by lightning typically employ the use of a varistor block that switches with overvoltage, dissipating the excess current and clamping the voltage transient. These modules may be supported and held together by use of a ceramic/porcelain housing and springs or fiberglass structures (crimped rod or wraps) to force sufficient block contact and provide mechanical structural integrity. Larger blocks may have issues dissipating heat when discharging large amounts of energy caused by defects and excessive heating. These issues may lead to eventful failure (e.g., explosion failure of block). Block interfaces, mechanical structure and voids are known issues that are difficult to control with existing designs. As block diameter increases, the center of the block generally does not uniformly share in dissipating the energy/current or is not as utilized as the outer portion of the varistor block. An example of such a current design block is shown in FIG. 1 and described in U.S. Pat. No. 5,680,289 ("the '289 patent").

Current varistor blocks generally become more difficult to manufacture as diameter increases for multiple reasons such as powder forming, drying and firing uniformity. The challenge of controlling these issues generally increases with diameter. An alternative approach first introduced by General Electric and subsequently licensed to other entities around the world included deploying the standard smaller blocks in parallel stacks, but employing the same previously cited structural designs, to alleviate the issues with larger block cost, availability and performance. Each of the stacks was separated from the others by air.

SUMMARY OF THE INVENTION

Embodiments of the present invention provide a high-voltage surge arrester including an electrically conductive first terminal and an electrically conductive second terminal longitudinally spaced from the first terminal. A plurality of metal oxide varistor (MOV) bars are included, each of which extends from the first terminal to the second terminal and electrically contacts the first terminal and the second terminal. A heat conducting material contacts a periphery of the MOV bars.

In other embodiments, a high-voltage surge arrester includes an electrically conductive first terminal and an electrically conductive second terminal longitudinally spaced from the first terminal. A plurality of MOV assemblies are stacked sequentially between the first terminal and the second terminal. At least one of the MOV assemblies includes a plurality of metal oxide varistor (MOV) bars. A heat conducting material extends between each of the plurality of MOV bars and others of the MOV bars to separate the MOV bars from each other.

In yet further embodiments, a method of manufacturing a high-voltage surge arrester includes selecting a desired length for each of a plurality of metal oxide varistor (MOV) bars based on a desired operating voltage of the surge arrester. A desired number of MOV bars to include in the plurality of metal oxide varistors is selected based on a desired current rating of the surge arrester. The desired number of MOV bars having the desired length are formed to provide the plurality of metal oxide varistor (MOV) bars. The plurality of MOV bars are arranged so that each of the MOV bars extends lengthwise from an electrically conductive first terminal of the surge arrester to an electrically conductive second terminal of the surge arrester and electrically contacts the first terminal and the second terminal. A heat conducting material is placed contacting the arranged MOV bars. The arranged plurality of MOV bars is secured to provide the surge arrester having the desired operating voltage and the desired current rating.

DETAILED DESCRIPTION OF EMBODIMENTS OF THE INVENTION

Figure 1:
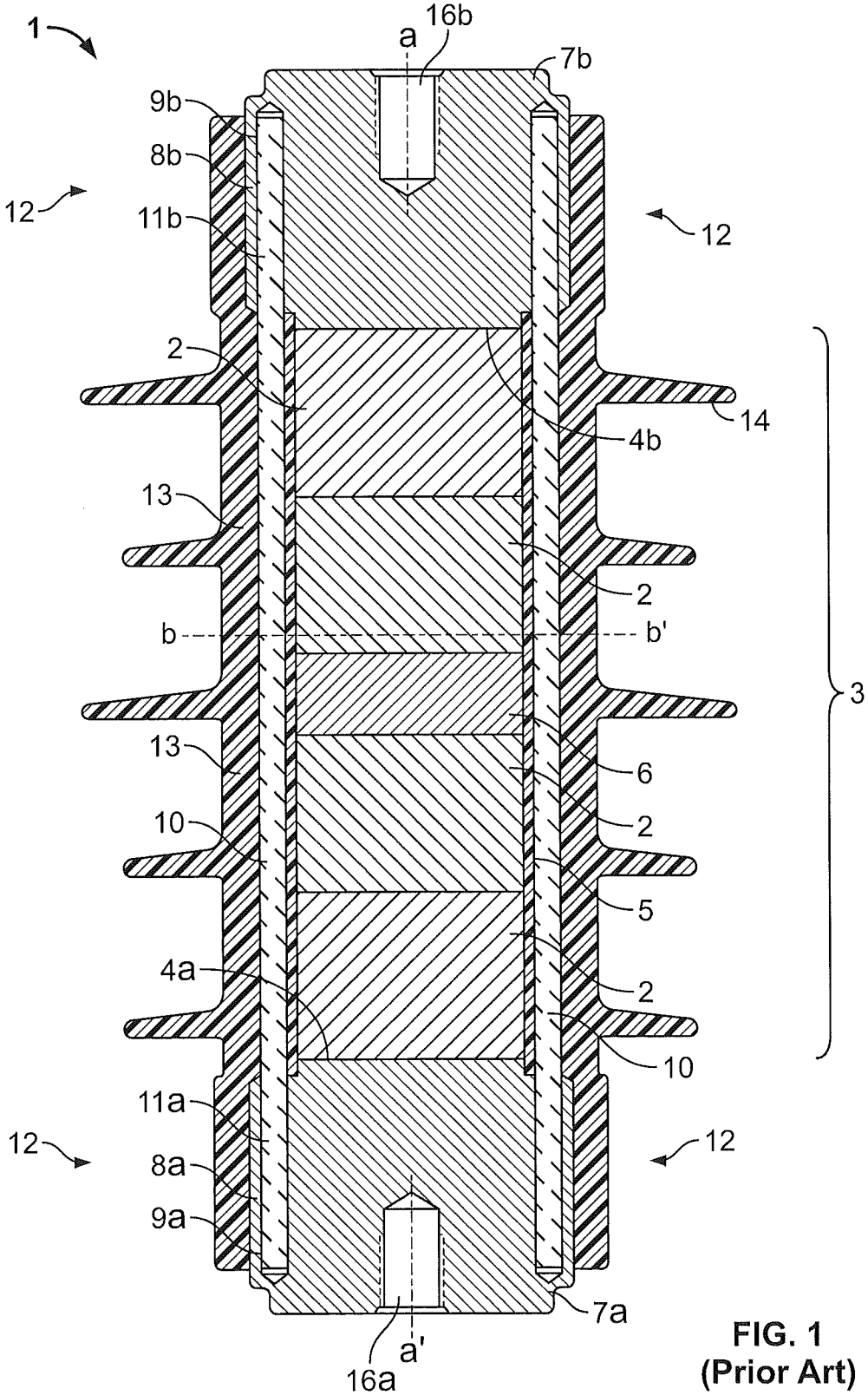
FIG. 1 (Prior Art)
FIG. 1 is a cross-sectional view illustrating a conventional surge arrester.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

A conventional stacked surge arrester 1 as described in the '289 patent is shown in FIG. 1. A plurality of varistor elements 2 forms a stack 3 having opposed end surfaces 4*a* and 4*b* and a lateral surface 5. The varistor elements 2 may be disk-shaped, so that stack 3 is cylindrical. Optional spacer 6 lies between two adjacent varistor elements 2 and is made of a conductive material such as metal, in particular aluminum. Stack 3 is held between first and second terminals 7*a* and 7*b*, which engage stack 3 at end surfaces 4*a* and 4*b* thereof and make electrical contact therewith. Terminals 7*a* and 7*b* are made of a metal such as aluminum and serve as the means by which surge arrester 1 is connected to ground and the system. Bores 16*a* and 16*b* in terminals 7*a* and 7*b*, respectively, are for receiving studs via which such connection is made. Bores 16*a* and 16*b* may be smooth surfaced, as shown here, or threaded. Terminals 7*a* and 7*b* also have flanges 8*a* and 8*b*, respectively, extending beyond lateral surface 5 of stack 3. Flanges 8*a* and 8*b* each have a plurality of recesses 9*a*, 9*b*, respectively, opening to face stack 3. The assembly of terminals 7*a*, 7*b*, and stack 3 is held together by a retaining member, shown as a plurality of strength members 10. Each strength member 10 has first and second ends 11*a* and 11*b* fitting into a corresponding recess 9*a* and 9*b*. Strength members 10 may be disposed symmetrically around stack 3, about longitudinal axis a-a', but an asymmetric disposition also may be used. Strength members 10 are spaced apart from lateral surface 5. There may be 4 or 6 strength members, but a greater or lesser number, even or odd, can be used. Ends 11*a*, 11*b* are tightly gripped inside recesses 9*a*, 9*b* by crimping terminals 7*a*, 7*b* at their exterior surfaces, at the locations generally indicated by arrows 12. During the crimping step, stack 3 and terminals 7*a*, 7*b* are held under compression so that, after crimping, strength members 10 (which are reciprocally under tension) hold stack 3 under compression, ensuring good electrical contact among varistor elements 2 and between end surfaces 4*a*, 4*b* and terminals 7*a*, 7*b*.

Strength members 10 may be made of a composite such as pultruded glass fiber reinforced resin, combining the better properties of glass (strong but with little elongation) and polymer resin (weaker but with good elongation and ability to bond glass to glass). The polymeric resin may be epoxy or vinyl ester resin. In pultrusion, a glass reinforced composite is made by impregnating continuous bundles of glass fibers with a liquid resin, then heating at an elevated temperature to cure the resin. Such materials are very strong in tension and have adequate bending strength. Also, they have excellent electrical properties and retain their electrical and mechanical properties at elevated temperatures. The ductility is still within acceptable limits, even though it is more ductile than glass. Alternative materials may be used, but are less preferred, including ceramics (e.g., porcelain), which have the strength but not the toughness of composites, and organic materials such as aramid (e.g., Kevlar™) or nylon, despite limitations such as lesser electrical properties or mechanical strength, increased creep, or increased moisture uptake.

A housing 13, which may be made of a polymeric material, is molded around the assembly such that the polymeric material encloses stack 3 and strength members 10 and fills the space between strength members 10 and stack 3. Housing 13 also partially covers terminals 7*a*, 7*b*. Housing 13 may have sheds 14 for increasing the surface leakage current path and may be made of a tracking resistant material, such as appropriately formulated polyolefin polymers and copolymers such as ethylene-vinyl acetate copolymer (EVA), ethylene-propylene-diene monomer terpolymer (EPDM), and ethylene-propylene rubber (EPR), or silicone, or the like. Also shown is a spacer 6, which is made of a thermally and electrically conductive material such as a metal.

Figure 2:
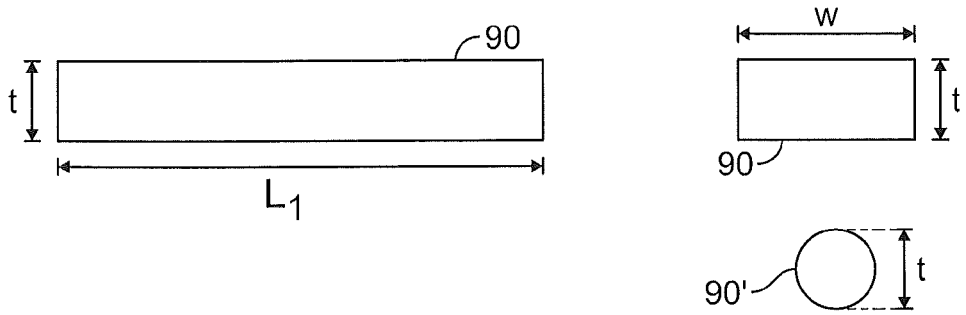
FIG. 2 is a side and end view of metal oxide varistor (MOV) bars according to some embodiments of the present invention.
Figure 3:
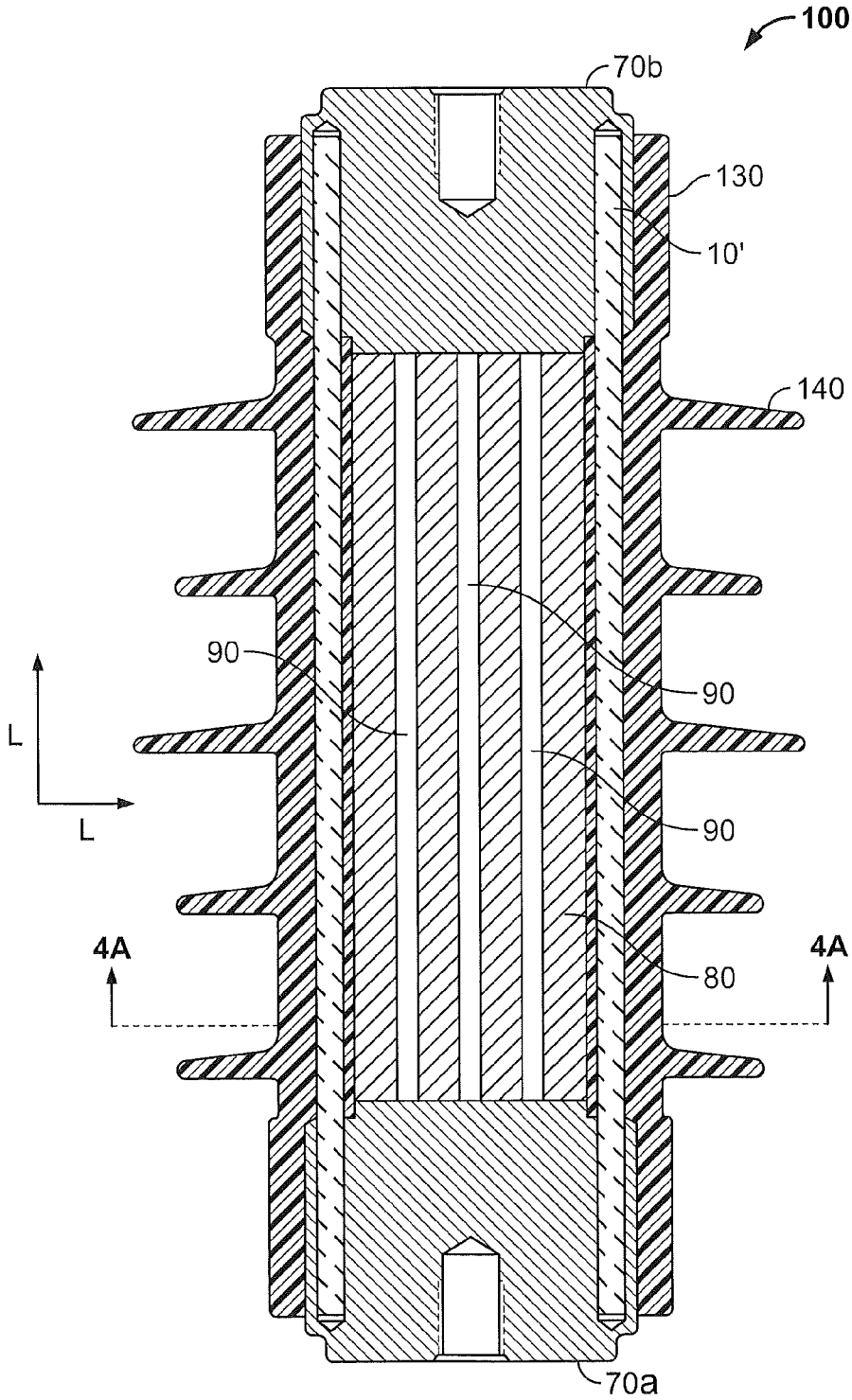
FIG. 3 is a cross-sectional view of a surge arrester according to some embodiments of the present invention.
Figure 4C:
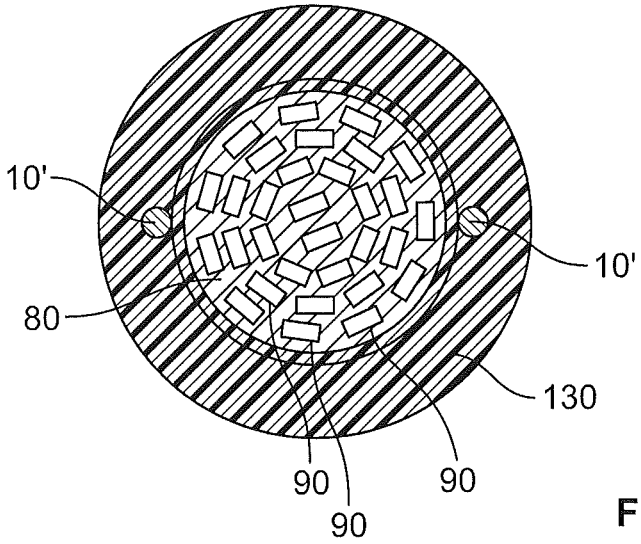
Figure 4D:
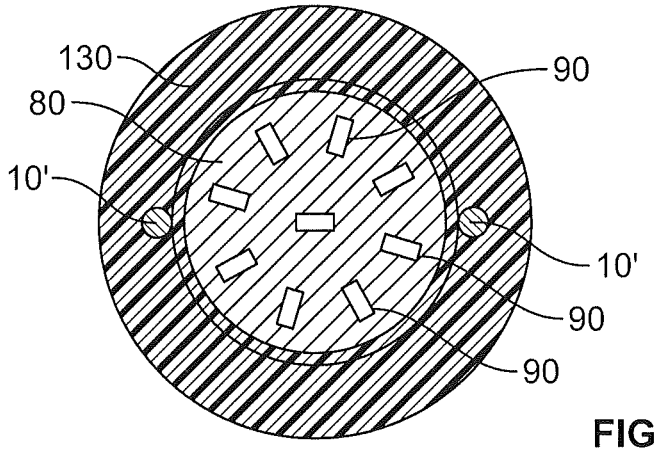
Figure 4E:
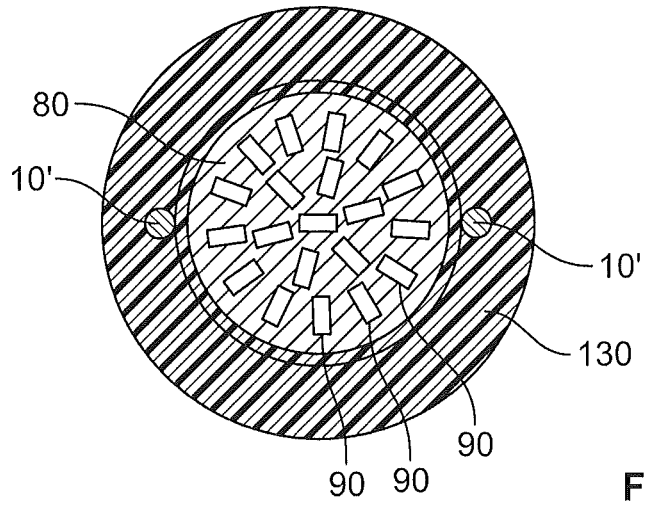
Figure 4F:
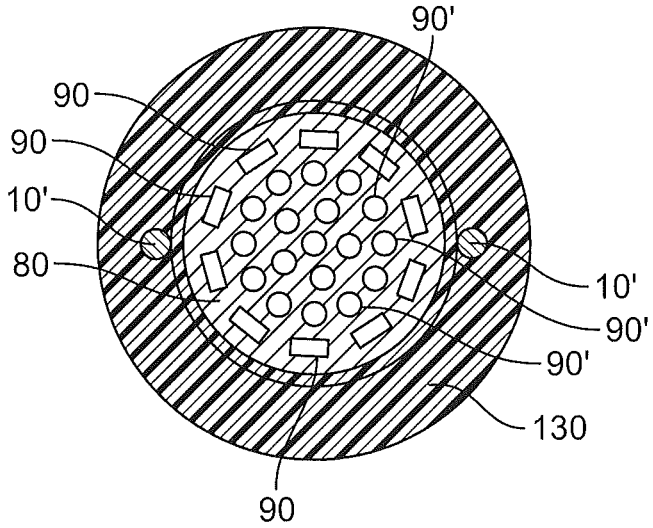
Figure 4G:
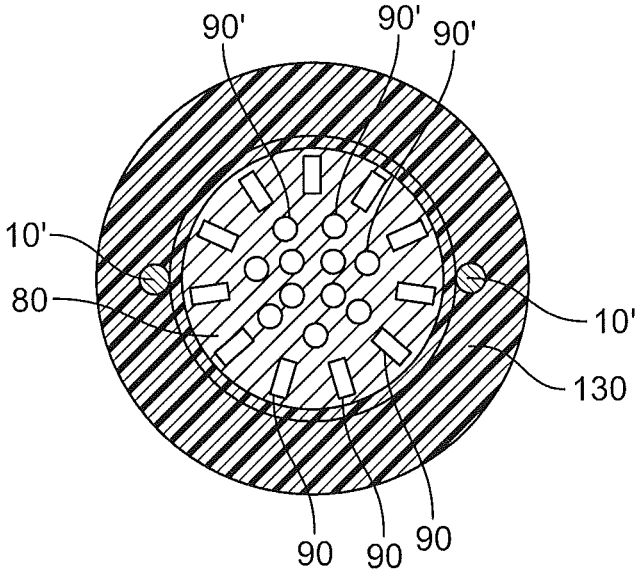

Some embodiments of the present invention will now be described with reference to FIGS. 2, 3 and 4A-4G. As seen in the embodiments of FIG. 3, a high-voltage surge arrester 100 includes an electrically conductive first terminal 70*a* and an electrically conductive second terminal 70*b* longitudinally spaced from the first terminal 70*a*. A plurality of metal oxide varistor (MOV) bars 90 extend from the first terminal 70*a* to the second terminal 70*b*. The MOV bars 90 each physically and electrically contact the first terminal 70*a* and the second terminal 70*b*. A heat conducting material 80 contacts a periphery of the MOV bars 90. As seen in FIG. 2, the heat conducting material 80 surrounds each of the MOV bars 90 to contact the entire periphery thereof between the terminals 70*a*, 70*b*.

Referring to FIG. 2, in some embodiments the MOV bars 90 are extruded or molded of relatively (to the prior art stack 3 of FIG. 1) long rectangular bars 90 or circular bars 90' of metal (e.g., zinc) oxide (varistors) that extend from the first terminal 70*a*, which may be a ground voltage reference connection to second terminal 70*b*, which may be a line voltage connection with a rectangular 90 or circular cross-section 90'. The extruded or molded MOV bars 90 may be monolithic. As used herein, "monolithic" means an object that is a single, unitary piece formed or composed of a material without joints or seams. These varistors can have a length $L_1$ selected to provide a desired operating voltage for the surge arrester 100, for example, a required length for the system voltage requirement for which they will be deployed. The number of MOV bars 90, 90' included in the plurality of MOV bars (and cross sectional area thereof) may be selected to provide a desired current rating for the surge arrester 100 depending on the required energy handling class.

The varistor bars 90, 90' may be bundled together by a retaining member such as a structural dielectric 10, 10' and encapsulated in a weatherproof housing 130, for example, by a slip fit housing or overmolding. The retaining member 10, 10' may secure the MOV bars 90, 90' in positions extending from the first terminal 70*a* to the second terminal 70*b* and hold a first end of the MOV bars 90, 90' proximate the first terminal 70*a* in electrically conductive contact with the first terminal 70*a* and hold a second end of the MOV bars 90, 90' proximate the second terminal 70*b* in electrically conductive contact with the second terminal 70*b*. The retaining member 10, 10' in some embodiments may support and/or encapsulate the MOV bars 90, 90', for example, using pultruded rods, fiberglass wraps, chopped fiber resin overmolding or ceramic/porcelain housing and springs.

In some embodiments, instead of or in addition to the retaining member 10, 10', the heat conducting material 80 is configured to secure the MOV bars 90, 90' in positions extending from the first terminal 70*a* to the second terminal 70*b* with a first end of the MOV bars 90, 90' proximate the first terminal 70*a* in conductive contact with the first terminal 70*a* and a second end of the MOV bars 90, 90' proximate the second terminal 70*b* in conductive contact with the second terminal 70*b*.

In some embodiments of the present invention, the dimensions of the MOV bars 90, 90' and the contact thereof with the heat conducting material 80 provide improved heat transfer characteristics that may result in improved performance during operation of the surge arrester 100 as the heat generated by current flow through the MOV bars 90, 90' may be dissipated more quickly. In addition, the cross-sectional dimensions of the MOV bars 90, 90' may provide more uniform current flow therethrough. Referring to FIG. 2, in some embodiments, each of the plurality of MOV bars 90, 90' has a thickness t of no more than 20 millimeters (mm). In some embodiments, each of the plurality of MOV bars 90 is rectangular in cross-section and has a width w of at least twice the thickness t of the MOV bars 90.

More generally, the design of the MOV bars 90, 90' may be optimized to the smallest possible dimensions to optimize not only electrical performance of the surge arrester 100 but such reduction in dimensions may also improve manufacturing speed and consistency of the MOV bars 90, 90' and final arrester assembly. As noted above, the MOV bar 90, 90' may be made with the <20 mm thickness, but could be made much wider and still dry to the required moisture content quickly during manufacture as there would not be a long distance from the center of the bar. Wider bars would also be able to contact the supporting, heat sink materials 80 to effectively dissipate heat.

The material of the MOV bars 90, 90' in some embodiments includes a zinc oxide powder. The zinc oxide powder may have a 1 micron particle size. Zinc oxide powder in the 1 micron particle size is known for use in varistors that may provide desired uniformity and varistor properties to the MOV bars 90, 90', such as described in U.S. Pat. No. 5,188,886, entitled "Metal oxide dielectric dense bodies, precursor powders therefor, and methods for preparing same," which is incorporated herein by reference as if set forth in its entirety.

Figure 4A:
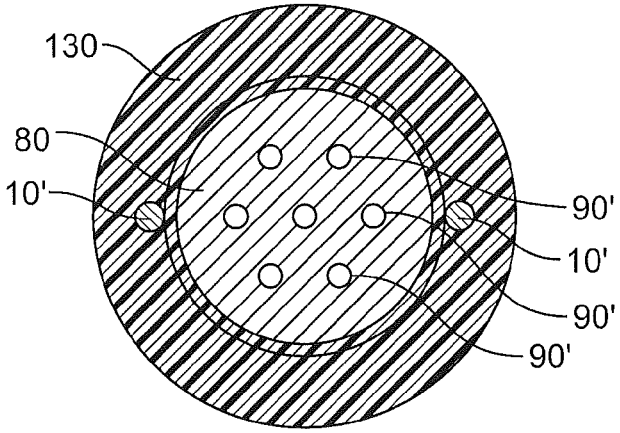
FIG. 4A is a cross-sectional view of the surge arrester of FIG. 3 taken along the line 4A-4A of FIG. 3.

The heat conducting material 80 may be a dielectric material. The heat conducting material 80 in some embodiments extends between each of the plurality of MOV bars and others of the MOV bars to separate the MOV bars from each other. As seen in FIG. 4A, in some embodiments, each of the plurality of MOV bars 90, 90' is electrically isolated from the others of the MOV bars 90, 90' so that a failure of one of the MOV bars 90, 90' does not cause a failure of others of the MOV bars 90, 90'. For example, larger energy class lightning arresters could have the MOV bars 90, 90' act independently so if one or more failed, they would be isolated reducing the energy class rating but still providing protection. While only seven MOV bars 90' are shown in FIG. 4A, it will be understood that more or less MOV bars 90' may be included in various embodiments.

Figure 4B:
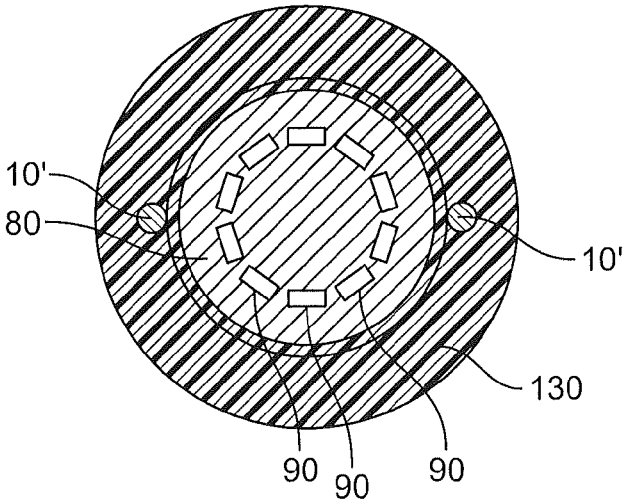
FIGS. 4B-4G are cross-sectional views of a surge arrester according to other embodiments of the present invention.

The relative arrangement of the MOV bars 90, 90' may also be selected to optimize a desired performance. For example, as seen in FIG. 4B, the plurality of MOV bars 90, 90' are arranged circumferentially to define a hollow cylinder extending from the first terminal 70*a* to the second terminal 70*b* and defining an interior cavity or passage. In such an arrangement, the MOV bars 90, 90' may or may not be in electrical contact but they are positioned close enough to each other to provide a magnetic coupling to allow the arranged plurality of MOV bars 90, 90' to act effectively as a hollow cylindrical varistor. Such a varistor configuration would otherwise be impractical to implement due to manufacturing limitations in forming the varistor. Further embodiments are illustrated in FIGS. 4C-4G, where various examples of arrangements of the MOV bars 90, 90' are shown, including a mix of rectangular bars 90 and circular bars 90' in the embodiments of FIGS. 4F and 4G. It will be understood that, as used herein, rectangular includes square and circular includes a range of smooth cross-sectional profiles such as ovals.

As such, embodiments of the present invention address and alleviate many manufacturing and performance issues of conventional stacked varistor arresters. Such benefits may result from eliminating interfaces of multiple stack blocks, molding or extruding of smaller profiles allowing easier control of their properties and increasing the efficiency of the varistor by the material used. In addition, some embodiments may improve manufacturing throughput by quicker drying and firing. Lightning arrester design may be improved by using the structure supporting the rods as both the dielectric and mechanical support. The energy handling characteristics of the deployed varistors may be improved along with the key characteristics of lightning arresters such as TOV, residual voltage, common mode overvoltage (MCOV) and total energy dissipation. The heat conducting material around the MOV rod may be used to dissipate heat and optimally locate the MOV bars.

As described above, a conventional surge arrester uses a stack of blocks of, for example, 3-5 kV heights (i.e., dimension in the stack direction). In such arresters, the blocks are generally sized (diameter) based on the designed energy handling requirement, typically stated in the arresters kiloamp (kA) rating. So, for distribution arresters, a 5 kA block may be 30 mm in diameter and a 10 kA block may be 40 mm. When arrester's are designed with a single block, stacked column, each block, as it dissipates energy, heats up and transfers heat throughout the block. MOV blocks have a positive temperature coefficient (PTC), thus, as the block's temperature rises, it is less likely to switch off (i.e., the block temporary overvoltage (TOV) handling capability drops). Thus, as more current is carried, the block will not switch off until a lower voltage than what it took it to turn on is experienced, often causing it to conduct to thermal failure, particularly in TOV situations.

In contrast, some embodiments of the present invention, due to separation and a narrower diameter of the MOVs, in total have much more surface area to dissipate heat, which may allow them to more reliably handle TOVs and retain their switching properties (in other words, a tighter TOV curve). As such, some embodiments provide a surge arrester having improved operating characteristics, leakage current conduction and improved life (as heat cycling ages and damages components).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed:

1. A high-voltage surge arrester, comprising:

an electrically conductive first terminal;

an electrically conductive second terminal longitudinally spaced from the first terminal;

a plurality of metal oxide varistor (MOV) bars, each of which extends from the first terminal to the second terminal and electrically contacts the first terminal and the second terminal; and a heat conducting material contacting a periphery of the MOV bars.

2. The surge arrester of claim 1, wherein the heat conducting material is configured to secure the MOV bars in positions extending from the first terminal to the second terminal with a first end of the MOV bars proximate the first terminal in conductive contact with the first terminal and a second end of the MOV bars proximate the second terminal in conductive contact with the second terminal.

3. The surge arrester of claim 1, further comprising a retaining member that secures the MOV bars in positions extending from the first terminal to the second terminal and holds a first end of the MOV bars proximate the first terminal in conductive contact with the first terminal and holds a second end of the MOV bars proximate the second terminal in conductive contact with the second terminal.

4. The surge arrester of claim 1, wherein each of the plurality of MOV bars has a thickness of no more than 20 millimeters (mm).

5. The surge arrester of claim 4, wherein each of the plurality of MOV bars has a circular or a rectangular cross-section.

6. The surge arrester of claim 1, wherein the heat conducting material extends between each of the plurality of MOV bars and others of the MOV bars to separate the MOV bars from each other.

7. The surge arrester of claim 6, wherein each of the plurality of MOV bars is electrically isolated from the others of the MOV bars so that a failure of one of the MOV bars does not cause a failure of others of the MOV bars.

8. The surge arrester of claim 1, wherein each of the plurality of MOV bars includes zinc oxide powder having a 1 micron particle size.

9. The surge arrester of claim 1, wherein the plurality of MOV bars have a length selected to provide a desired operating voltage for the surge arrester and wherein a number of the MOV bars is selected to provide a desired current rating for the surge arrester.

10. The surge arrester of claim 9, wherein each of the plurality of MOV bars is rectangular and has a thickness of no more than 20 millimeters (mm) and a width of at least twice the thickness of the MOV bars.

11. The surge arrester of claim 1, wherein the plurality of MOV bars are arranged circumferentially to define a hollow cylinder extending from the first terminal to the second terminal.

12. The surge arrester of claim 1, wherein the heat conducting material comprises a dielectric material.

13. The surge arrester of claim 1, further comprising a housing around the MOV bars and extending from the first terminal to the second terminal.

14. The surge arrester of claim 1, wherein each of the MOV bars is monolithic.

15. A high-voltage surge arrester, comprising:

an electrically conductive first terminal;

an electrically conductive second terminal longitudinally spaced from the first terminal; and a plurality of MOV assemblies stacked sequentially between the first terminal and the second terminal, wherein at least one of the MOV assemblies includes a plurality of metal oxide varistor (MOV) bars and a heat conducting material extending between each of the plurality of MOV bars and others of the MOV bars to separate the MOV bars from each other.

16. The surge arrester of claim 15, wherein each of the plurality of MOV bars is rectangular and has a thickness of no more than 20 millimeters (mm) and a width of at least twice the thickness of the MOV bars and wherein the heat conducting material comprises a dielectric material.

17. The surge arrester of claim 15, further comprising a retaining member that secures the stacked MOV assemblies extending from the first terminal to the second terminal and holds a first end of the stack of MOV assemblies proximate the first terminal in conductive contact with the first terminal and holds a second end of the stack of MOV assemblies proximate the second terminal in conductive contact with the second terminal.

18. A method of manufacturing a high-voltage surge arrester, comprising:

selecting a desired length for each of a plurality of metal oxide varistor (MOV) bars based on a desired operating voltage of the surge arrester;

selecting a desired number of MOV bars to include in the plurality of metal oxide varistors based on a desired current rating of the surge arrester;

forming the desired number of MOV bars having the desired length to provide the plurality of metal oxide varistor (MOV) bars;

arranging the plurality of MOV bars so that each of the MOV bars extends lengthwise from an electrically conductive first terminal of the surge arrester to an electrically conductive second terminal of the surge arrester and electrically contacts the first terminal and the second terminal;

placing a heat conducting material contacting the arranged MOV bars; and securing the arranged plurality of MOV bars to provide the surge arrester having the desired operating voltage and the desired current rating.

19. The method of claim 18, wherein forming the desired number of MOV bars includes extruding desired number of MOV bars to have a thickness of no more than 20 millimeters (mm) and a width of at least twice the thickness of the MOV bars.

20. The method of claim 18, wherein forming the desired number of MOV bars includes forming the MOV bars including a zinc oxide powder having a 1 micron particle size therein and wherein the heat conducting material comprises a dielectric.

* * * * *